US011282313B2

(12) United States Patent
Jesme et al.

(10) Patent No.: US 11,282,313 B2
(45) Date of Patent: Mar. 22, 2022

(54) SMART LOCKING SYSTEMS AND METHODS

(71) Applicant: 3M INNOVATIVE PROPERTIES COMPANY, St. Paul, MN (US)

(72) Inventors: Ronald J. Jesme, Plymouth, MN (US); Cory M. Arthur, Eagan, MN (US); Kandyce M. Bohannon, White Bear Lake, MN (US); Eric J. Larson, Bayport, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 17/247,788

(22) Filed: Dec. 23, 2020

(65) Prior Publication Data

US 2021/0201607 A1 Jul. 1, 2021

Related U.S. Application Data

(60) Provisional application No. 63/124,186, filed on Dec. 11, 2020, provisional application No. 62/955,926, filed on Dec. 31, 2019.

(51) Int. Cl.
*G07C 9/00* (2020.01)

(52) U.S. Cl.
CPC ..... *G07C 9/00309* (2013.01); *G07C 9/00571* (2013.01); *G07C 2009/00634* (2013.01); *G07C 2009/00769* (2013.01)

(58) Field of Classification Search
None
See application file for complete search history.

(56) References Cited

U.S. PATENT DOCUMENTS

| | | | | |
|---|---|---|---|---|
| 6,446,049 | B1 * | 9/2002 | Janning | G06Q 20/327 705/40 |
| 9,778,626 | B2 | 10/2017 | Nixon | |
| 10,398,247 | B2 * | 9/2019 | Garrity | H02J 50/10 |
| 10,453,285 | B2 * | 10/2019 | Steinmetz | G07C 9/28 |
| 2004/0068935 | A1 * | 4/2004 | Ichikawa | E05B 85/01 49/25 |
| 2006/0048233 | A1 * | 3/2006 | Buttress | G07C 9/215 726/27 |
| 2011/0241838 | A1 | 10/2011 | Wischmeyer | |
| 2011/0291846 | A1 * | 12/2011 | Burdenko | E05B 47/0004 340/635 |
| 2016/0047142 | A1 * | 2/2016 | Gengler | G07C 9/00571 340/5.61 |
| 2016/0340586 | A1 * | 11/2016 | Auth | E04B 1/941 |
| 2020/0071957 | A1 * | 3/2020 | Chen | E05B 47/06 |

FOREIGN PATENT DOCUMENTS

WO WO 2016-200671 12/2016

* cited by examiner

*Primary Examiner* — Carlos Garcia
(74) *Attorney, Agent, or Firm* — Yufeng Dong

(57) ABSTRACT

Smart locking devices, systems and methods are provided. A user mobile device can transmit a wireless signal to an electronic locking device. The electronic locking device includes a power sensor to sense the harvested power, and a controller to process the communication component to determine an algorithm to operate the electronic locking device. The mobile device is connected to a network environment where user authentication and encryption data can be generated, stored, and relayed to multiple user mobile devices for wireless key management for authentication.

20 Claims, 6 Drawing Sheets

SMART LOCKING SYSTEMS AND METHODS

This application claims the benefit of US Provisional Application Nos. 62/955,926, filed Dec. 31, 2019, and 63/124,186, filed Dec. 11, 2020, the disclosures of which are incorporated by reference in their entirety herein.

BACKGROUND

Electronic locks are widely used where locking/unlocking locks can be controlled by a user device over a wireless connection (e.g., Wi-Fi, etc.).

SUMMARY

In one aspect, the present disclosure describes an electronic locking device. The electronic locking device including a wireless transceiver including an antenna configured to receive wireless signals; a duplexer functionally connected to the antenna to separate the received wireless signal into a power component and a communication component; a power sensor to sense the amount of the power component; and a controller configured to: determine whether the sensed amount of the power component is enough to operate the electronic locking device; and process the communication component to determine an algorithm to operate the electronic locking device.

In another aspect, the present disclosure describes a smart locking system. The smart locking system includes one or more of the electronic locking devices described herein; and one or more user mobile devices, each user mobile device providing a user interface allowing a user access to the one or more electronic locking devices.

In another aspect, the present disclosure describes a smart locking method including impinging a wireless signal from a user mobile device on an antenna of an electronic locking device; sensing the power level of the wireless signal; determining whether the sensed power level is sufficient to operate the electronic locking device; and processing the wireless signal to determine an algorithm to operate the electronic locking device.

Various unexpected results and advantages are obtained in exemplary embodiments of the disclosure. One such advantage of exemplary embodiments of the present disclosure is that the lock system is not dependent upon power to engage or disengage the lock. The state of the equipment can be kept current and remotely viewed via, for example, a web application, rather than requiring a user to physically visit the equipment. The system can be set up so that only the properly authorized users can lock, unlock or check the status of equipment.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF THE DRAWINGS

The disclosure may be more completely understood in consideration of the following detailed description of various embodiments of the disclosure in connection with the accompanying figures, in which.

Figure 1:
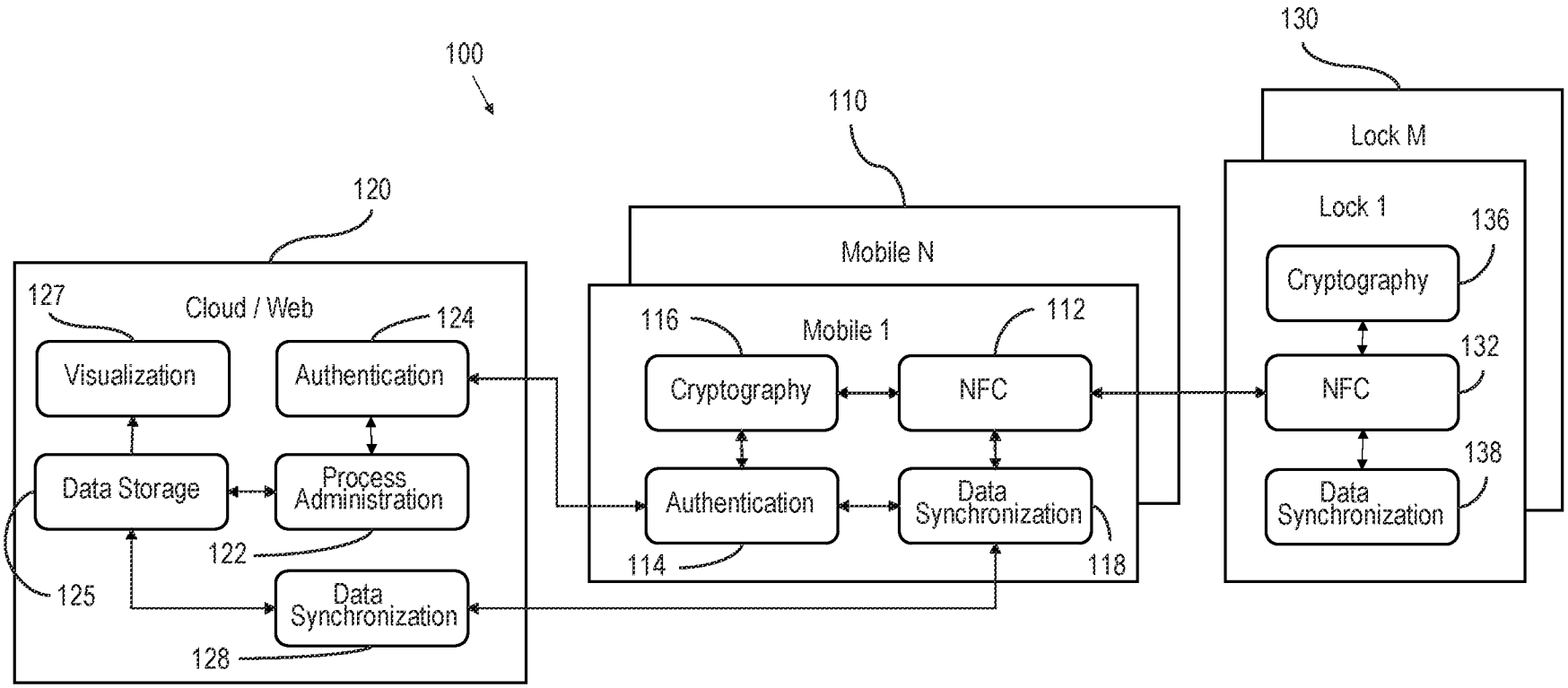
FIG. 1 is a block diagram of a smart locking system, according to one embodiment.

In the drawings, like reference numerals indicate like elements. While the above-identified drawing, which may not be drawn to scale, sets forth various embodiments of the present disclosure, other embodiments are also contemplated, as noted in the Detailed Description. In all cases, this disclosure describes the presently disclosed disclosure by way of representation of exemplary embodiments and not by express limitations. It should be understood that numerous other modifications and embodiments can be devised by those skilled in the art, which fall within the scope and spirit of this disclosure.

DETAILED DESCRIPTION

Smart locking devices, systems and methods are provided. A user mobile device can transmit a wireless signal to an electronic locking device which is separated into a power component and a communication component. The electronic locking device includes a power sensor to sense the amount of the power component, and a controller configured to determine whether the sensed amount of the power component is enough to operate the electronic locking device, and process the communication component to determine an algorithm to operate the electronic locking device. One or more of such user mobile devices can be connected to a network environment where user authentication and encryption data can be generated, stored, and relayed to the user mobile devices for wireless key management for authentication.

Referring to FIG. 1, a block diagram of a smart locking system 100 is shown, according to one embodiment. The system 100 includes one or more (integer N not less than one) user mobile devices 110, a network environment 120, and one or more (integer M not less than one) electronic locking devices 130. The electronic locking devices described herein include no battery. Instead, the user mobile devices 110 each can provide wireless power to the electronic locking devices 130. The user mobile device can also manage, via the network environment 120, the operation of the electronic locking devices 130 by, for example, unlocking, locking, or otherwise managing the function of the electronic locking devices 130.

The network of wirelessly controlled locks 130 do not require a battery, where the network can inform users of the status of the locks when the use is "anywhere" (e.g., near the lock, on a plane, in their office, on a work site, etc.) on using "any" device (e.g., phone, laptop, desktop PC, etc.). "No battery required" removes the limitations of batteries from the lock, e.g., the performance of the lock is not necessarily limited by the temperature limitations of a battery, the self-discharge limitation of a battery, the need to replace or recharge a battery, the proper disposal of a battery, etc.

In the depicted embodiment of FIG. 1, the user mobile devices 110 are smartphones using near-field communication (NFC) interface 112 to provide wireless power to the electronic locks 130 via the respective NFC interfaces 132 of the electronic locks 130. The NFC interfaces 112 of the smartphones 110 also communicate with the respective NFC interfaces 132 of the electronic locking devices 130 to exchange data by transmitting and receiving various signals including, for example, command signals, status signals, action signals, etc.

The network environment 120 can include, for example, cloud-based computers, servers, web applications, etc., which are used in some embodiments to manage data or interactions. In the depicted embodiment of FIG. 1, a cloud computer/server or a web application implemented by a process administration module 122 can access a user database stored in the data storage 125 to authenticate or denial of access request, via the authentication module 124.

For example, in some embodiments, authorization of one or more users can be managed by a web application running on a cloud-based server. The web application allows to create and define various authorizations for multiple users. The web application allows a user with the respective authorization to interact with the web application and the electronic locks under the authorized right. For example, the web application allows a user to use a valid username and password to create and view data in the web application as well as log into a mobile application where interaction with the locks and equipment occurs.

In some embodiments, the authorization of multiple users can be conducted via a network environment, e.g., a web application based on a cloud computer or server. The metadata associated with the user's authorization packet can be encoded into a special string of characters that is used as a key to lock and unlock equipment. In this way the locking device can store the same decoding cipher in its memory, and the user's authorization key is made in such a way that it can be used on all of the equipment it has access to. Furthermore, this allows the user's authorization key to be updatable, which must be done each time authorization changes and it can also be done on a regular cadence as dictated by security best practices.

In the embodiment depicted in FIG. 1, a web application running in the network environment 120 includes a process administration module, an authentication module 124, a data synchronization module 128, a data storage module 125, and a visualization module 127. A mobile application running in a user mobile device includes an authentication module 114, a cryptography module 116, an NFC module 112, and a data synchronization module 118.

For the network environment 120, the visualization module 127 is a user interface or means that one or more users can interact with the function and status of the system. The authentication module 124 is the mechanism to verify that mobile devices 110 are valid and the system can securely pass data to them. The data storage module 125 is a bulk storage database for system data amalgamation. The data synchronization module 122 is the mechanism that takes the required data and organizes it and provides a means to ensure that the proper personnel have access to the correct data at that correct time and have the authorization to change the data (lock, unlock, or override). The process administration module 122 can include the relevant guidelines and configurable rules for the system to be able to function as each customer site requires.

For each user mobile device, the cryptography module 116 has the specific authentication keys required to insure highly secure communication protocol. The NFC module 112 contains the ability to interface with NFC hardware, either internal or external to the mobile device and provide the power sequence and communication mechanism to the lock. The authentication module 114 and data synchronization module 118 are the same as 124 and 128 respectively within the cloud/web application 120.

In some embodiments, when the first time a user logs into the mobile application, the user's cryptographic data such as, for example, a cryptographic fingerprint can be gathered by the cryptography module 116. The cryptographic data can be part of a valid application download to be transmitted along with the user provided username and password. The cryptographic data can be validated by the web application to ensure that the mobile application is valid. After the web application has validated the user credentials and mobile application fingerprint, the data that this user is authorized to view can be packaged up and sent to the mobile application running in the user's mobile device. Such an interaction may occur for every user who logs into the mobile application. In this manner, each user's mobile device can contain a unique hash that is validated with the web application.

Similar to the validity checking interaction that occurs between the mobile device and the web application, the locks also have cryptographic data such as, for example, a cryptographic fingerprint obtained by the cryptography module 136, embedded in the memory of the device. When a user approaches the lock while the NFC 112 of the mobile device with the application installed on it, the mobile application ensures the validity of the lock before completing any communication between the lock and mobile. In some embodiments, this validity check is possible even without network communication because lock cryptographic fingerprints can be part of the initial download from the web application to the mobile application. In addition to validating that the mobile application and lock are authentic, before any information is exchanged the application ensures that the currently logged in user has access to change the lock state or view the data returned from the lock. The interaction of validating the authenticity of the lock and the mobile application can be unique for each lock and instance of the installed mobile application.

Figure 2:
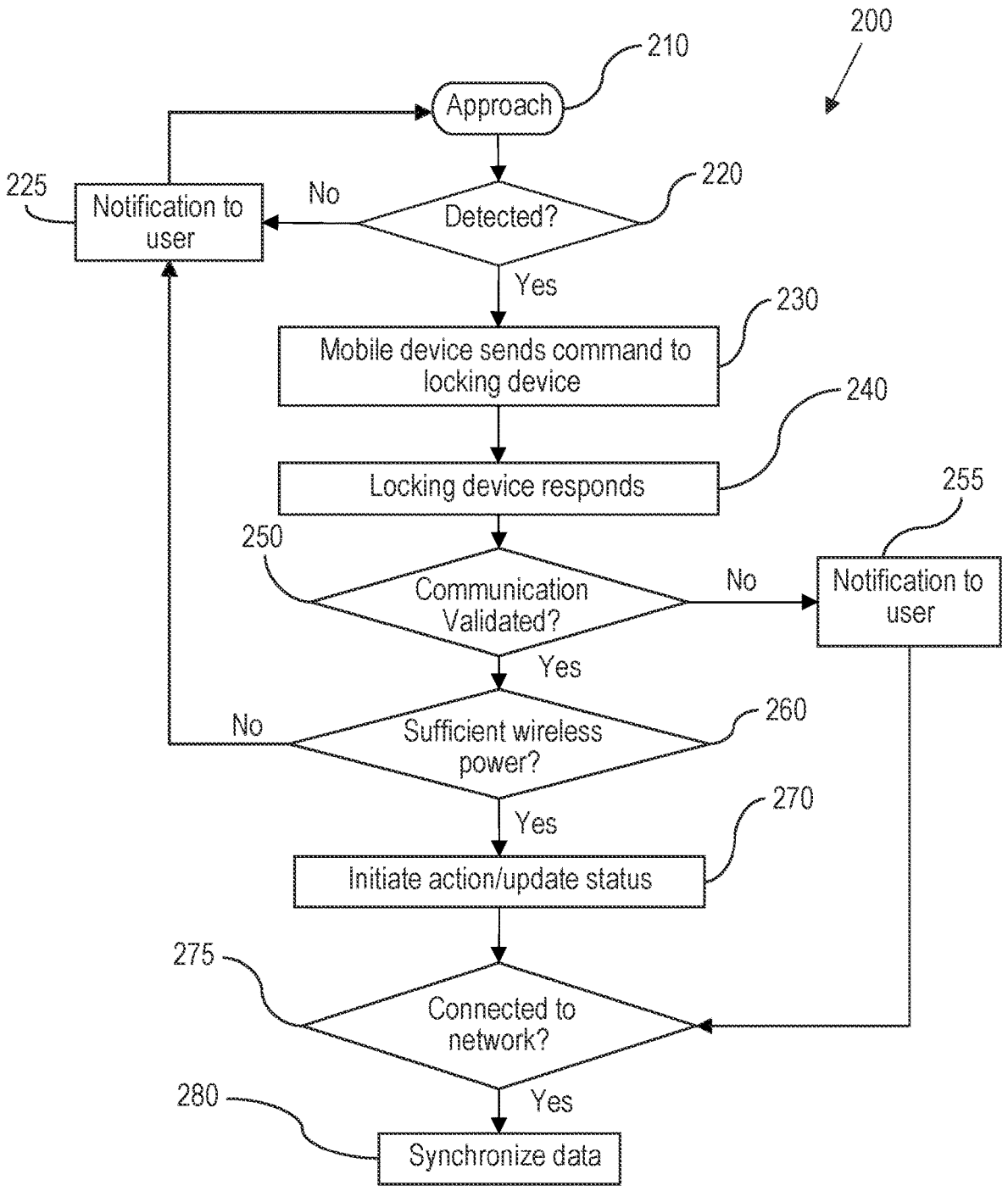
FIG. 2 is a flow diagram of user mobile devices interacting with electronic locking devices, according to one embodiment.

FIG. 2 is a flow diagram of a smart locking method 200 where one or more of the user mobile devices 110 interact with one or more of the electronic locking devices 130 of FIG. 1, according to one embodiment. At 210, the user mobile devices 110 are provided to approach the electronic locking devices 130. A user might have successfully logged into a user interface provided by the user mobile devices 110 via a smart locking device management application that is configured to run on the user mobile devices 110. For example, a mobile app may be installed on a smartphone in a memory thereof, where initial data can be downloaded from the network environment 120 to the memory of the user mobile devices 110. Initial data downloaded may include, for example, permissions for the current user's role-based access, current status of the locks that this user has access to including a hashed version of the locks' cryptographic fingerprints, and any processes that the current user is scheduled to complete in the next week. The mobile app can be used to configure and control the electronic locking devices 130. One or more user input components such as, for example, a touch screen, a speaker, a keyboard, etc., can be included in the user mobile devices 110 to allow a user to interact with the mobile devices 110. The method 200 then proceeds to 220.

At 220, the NFC interface 112 of the user mobile devices 110 can detect, via the interaction with the NFC interface 132 of the locking device 130, whether there are any electronic locking devices 130 in proximity. When the NFC interface 112 determines that no electronic locking device 130 is in proximity, the method 200 proceeds to 225 where a user interface of the mobile devices 110 may present notification/indication to the user that the smartphone location or orientation needs to change to interact with the electronic locking device 130. When the NFC interface 112 determines that there is at least one electronic locking device 130 in proximity, the method 200 proceeds to 230. At 230, the user mobile devices 110 send one or more command signals to the electronic locking devices 130 via the NFC interfaces 112 and 132. Command signals may include, for example, request for checking the status of the electronic locking device, or request for locking or unlocking the lock device. Upon receiving the command signal from the user mobile devices 110, the electronic locking devices 130 can send response signal to the user mobile devices 110. At 240, the user mobile devices 110 receive and process the response signal.

At 250, the user mobile devices 110 validates the communication between the user mobile devices 110 and the electronic locking devices 130 (e.g., the command and response signals). For example, the user mobile devices 110 include an authentication module 114 configured to determine whether the communication between the user mobile devices 110 and the electronic locking devices 130 is valid, whether the communication includes a proper header and/or a proper footer, whether the communication has any bit errors, whether the communication includes a valid authorization signature, whether the communication has been property encrypted, etc. In some embodiments, the user mobile devices 110 may communicate with the network environment 120 to validate the communication between the user mobile devices 110 and the electronic locking devices 130 (e.g., the command and response signals). For example, the user mobile devices 110 include an authentication module 114 configured to relay authentication information from the network environment 120 to determine whether the communication between the user mobile devices 110 and the electronic locking devices 130 is valid.

When the communication between the user mobile devices 110 and the electronic locking devices 130 is not valid, the method 200 proceeds to 255 where the user mobile devices 110 can notify/indicate to the user the reasons that the communication between the user mobile devices 110 and the electronic locking devices 130 is invalid (e.g., due to mismatched signatures). The method 200 then proceeds to 275.

When the communication between the user mobile devices 110 and the electronic locking devices 130 is valid, the method 200 proceeds to 260 where the user mobile devices 110 process the response signal from the electronic locking devices 130 to determine whether more wireless power is needed from the user mobile devices 110 for the electronic locking devices 130 to implement the command from the user mobile devices 110.

When the user mobile devices 110 determines that more wireless power is needed from the user mobile devices 110 to the electronic locking devices 130, the method 200 proceeds back to 225. When the user mobile devices 110 determines that the wireless power from the user mobile devices 110 to the electronic locking devices 130 is sufficient, the method 200 proceeds to 270 where the electronic locking devices 130 initiate an action according to the command signal from the user mobile devices 110, and update its status with the user mobile devices 110 via its data synchronization module 138. Then the method 200 proceeds to 275 to determine whether the user mobile devices 110 connect to the network environment 120. When the user mobile devices 110 connect to the network environment 120, the user mobile devices 110 update, via its data synchronization module 118 and the data synchronization module 128 of the network environment 120, the status of the electronic locking devices 130 with the network environment 120.

The data synchronization process can begin with the mobile application sending the newly acquired data to the web application. The data that is transmitted to the web application may include, for example, any updates or changes that were made since the last time the mobile application synchronized with the backend. Additionally, any status data collected by the user mobile device from the locking device can be sent to the web application. After uploading the data from the mobile application, the data synchronization module 128 in the web application can send data that it has received from other mobile or web sessions to the mobile device that requested the new information. Data may not flow from one locking device to another locking device, or from one mobile device to another mobile device. Instead, data is gathered by the mobile application from the locking device in the field and sent to the web application which is responsible for disseminating data to mobile application sessions which can make changes to the current status of any locking device in the system.

Figure 3:
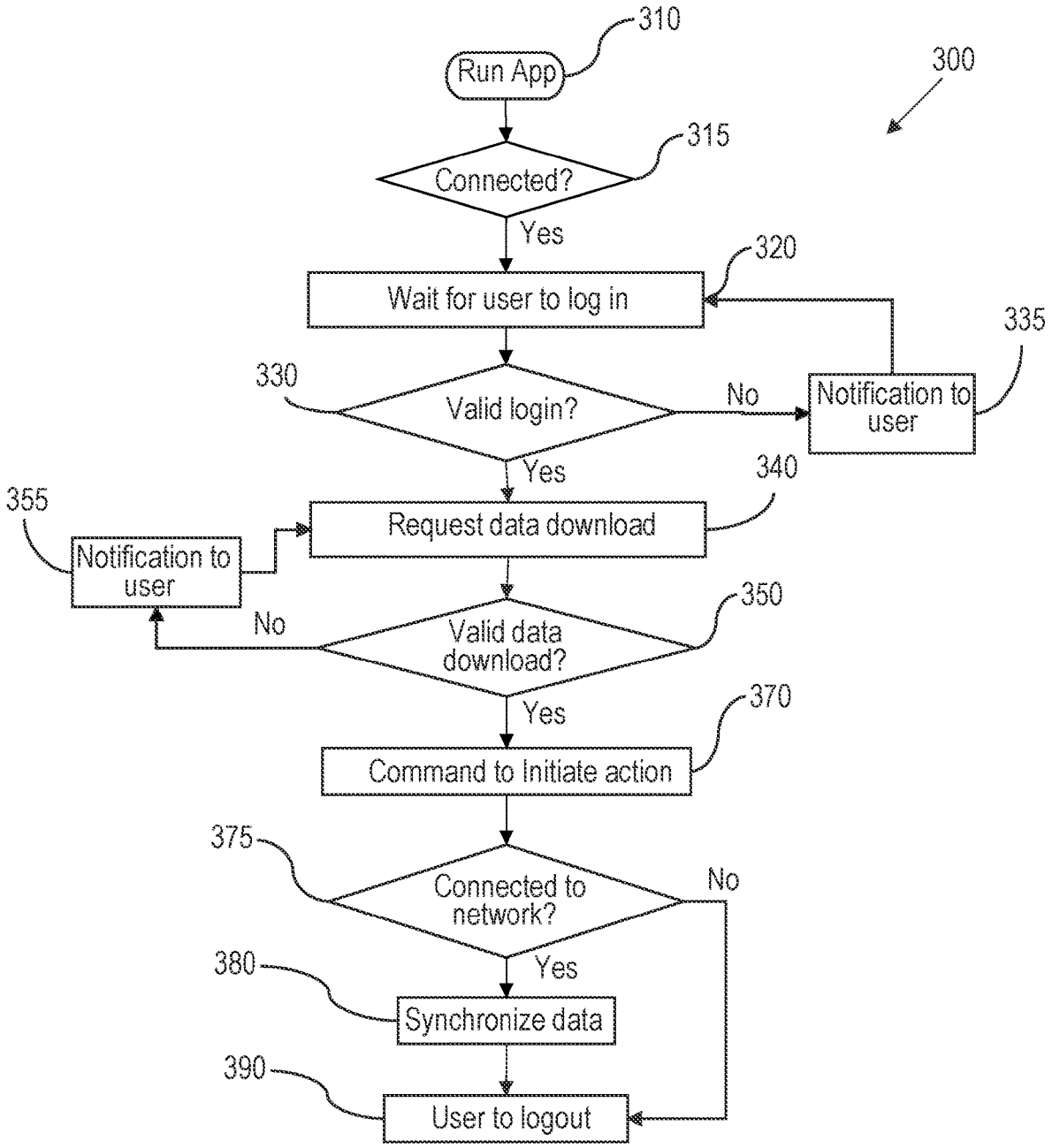
FIG. 3 is a flow diagram of the user mobile devices of FIG. 2 interacting with a network environment, according to one embodiment.

The user mobile devices 110 further includes a transceiver for communicating with the network environment 120 including, for example, a remote server, an access network and/or an IP network to connect with the remote server, etc. FIG. 3 is a flow diagram of the method 300 of the mobile devices 110 interacting with the network environment 120, according to one embodiment. At 310, the user mobile devices 110 is provided with a smart locking device management application that is configured to run on the user mobile devices 110. At 315, the method determines whether the user mobile devices 110 connect to the network environment 120. If the user mobile devices 110 connect to the network environment 120, the method 300 proceeds to 320 where the user interface allows the user to log into the smart locking device management application, e.g., with a username and a password. The method 300 then proceeds to 330 where the login information can be processed by the authentication module 114 and communicated to the authentication module 124 of the network environment 120 to determine whether the login information is valid, whether the user is an authorized user, whether the communication includes a proper header and/or a proper footer, whether the communication has any bit errors, whether the communication includes a valid authorization signature, whether the communication has been property encrypted, etc.

When the login information is not valid, the method 300 proceeds to 335 where the user mobile devices 110 can indicate to the user the reasons that the login is invalid (e.g., there is a problem with the user's credentials or signatures). The method 300 then proceeds back to 320.

When the login information is valid, the method 300 proceeds to 340 where the data synchronization module 118 of the user mobile devices 110 request data download from the data storage 125 of the network environment 120 via its data synchronization module 128. The downloaded data may include authorization information gathered at the data storage 125 of the network environment 120 regarding the right of the user to access the electronic locking devices 130. The method 300 then proceeds to 350.

At 350, the user mobile devices 110 determine whether the downloaded data is valid, for example, whether the downloaded data includes a proper header and/or a proper footer, whether the downloaded data has any bit errors, whether the downloaded data includes a valid authorization signature, whether the downloaded data has been property encrypted, etc. If the user mobile devices 110 determine that the downloaded data is invalid, the method 300 proceeds to 355 where the user mobile devices 110 can indicate to the user that there is a problem with the user's right to access the electronic locking devices 110. The method 300 then proceeds back to 340.

When the user mobile devices 110 determine that the downloaded data is valid, the method 300 proceeds to 360 where the user mobile devices 100 send command signals to the electronic locking devices 130 to initiate an action according to the command signal. Then the method 300 proceeds to 375 to determine whether the user mobile devices 110 connect to the network environment 120. When there is no network connection available, the method 300 proceeds to 390 where the user can log out. The user can continue with his work without synchronizing data that the mobile session has gathered nor retrieving any data collected from other mobile applications or the web interface until connectivity is regained.

When the user mobile devices 110 connect to the network environment 120, the user mobile devices 110 update, via its data synchronization module 118 and the data synchronization module 128 of the network environment 120, the status of the electronic locking devices 130 with the network environment 120. The method 300 then proceeds to 390 where the user mobile devices 110 request the user to logout the app. The user may choose to continue using the mobile application if there is more work to do before logging out of the mobile application. In some embodiments, the user's credential or authentication may expire and the mobile device may request the user reconnecting and updating to keep credentials up to date.

Figure 4:
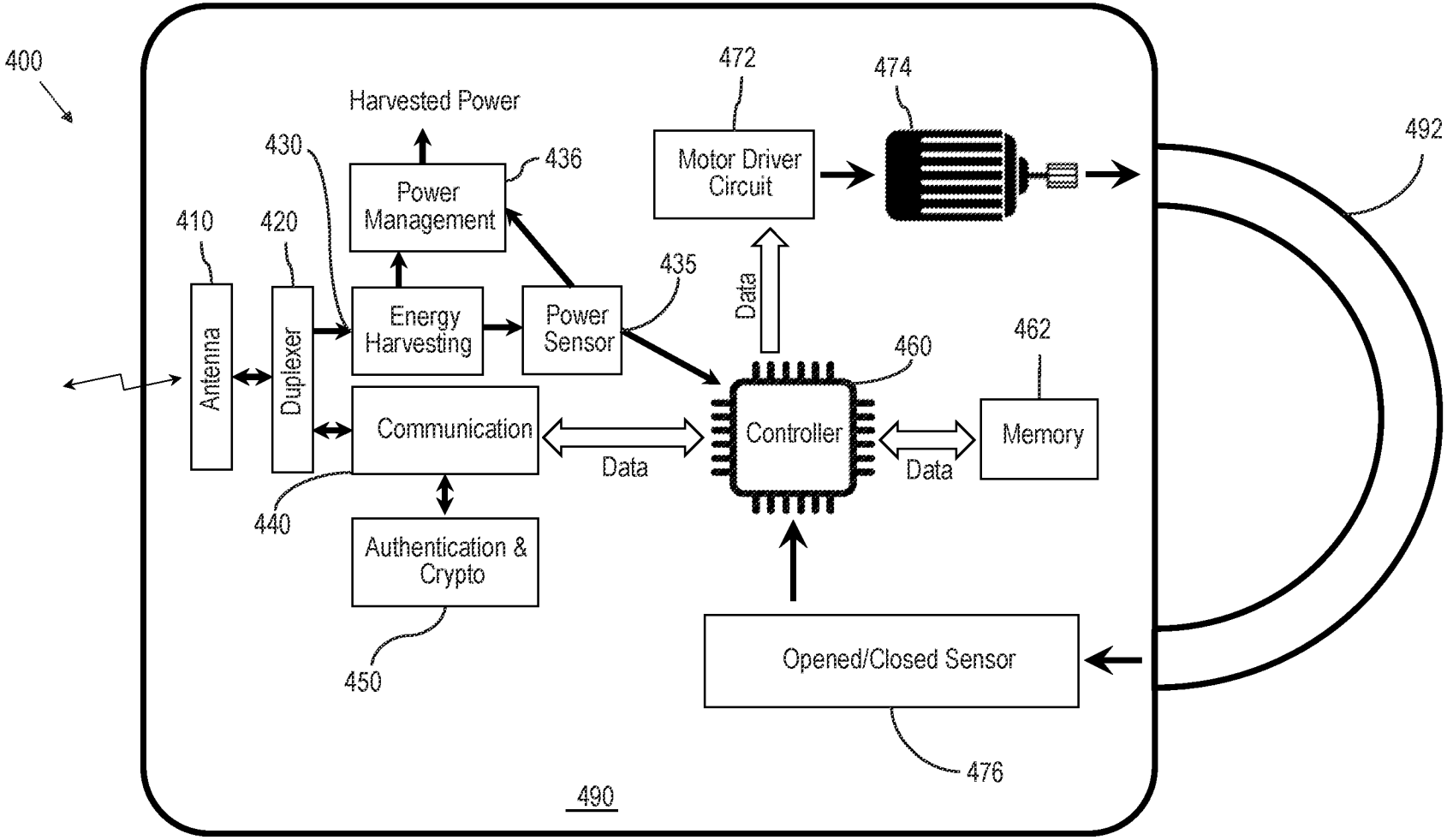
FIG. 4 is a block diagram of an electronic locking device, according to one embodiment.

FIG. 4 is a block diagram of an electronic locking device 400, according to one embodiment. The electronic locking device 400 includes a physical body 490 that can house and protect at least some components of the locking device 400. A padlock hasp 492 is attached to the body 490 that serves as the mechanical portion of the device 400 in a locked or unlocked position. The padlock hasp 492 can be driven by a motor 474 to switch between the locked and unlocked positions. It is to be understood that the body 490 and the padlock hasp 492 can have various configurations as long as they can fulfil the general requirements for a locking device. The motor 474 can be any suitable electromechanical system allowing the padlock hasp 492 to be mechanically opened or closed.

The electronic locking device 400 further includes a wireless transceiver including an NFC antenna 410 configured to receive wireless signals 5 from a user mobile device such as the user mobile device 110 of FIG. 1. The electronic locking device 400 further includes a duplexer 420 functionally connected to the antenna to separate the received wireless signal 5 into a power component and a communication component. The wireless signals may not directly deliver a dc power, but may transmit an ac power. When the ac power is received by the NFC antenna, it is rectified by the duplexer 420 to create a dc power component while preserving the ac communication component that carries the data communication information. The ac communication component can then be delivered to the communication processing function through a capacitor that can pass the ac commination signal but block the dc power. The dc power can be provided to the energy harvesting signal through an inductive component that can pass the dc power but impede the ac communication signal. It is to be understood that while near-field communication (NFC) is used in some embodiments herein, other suitable wireless technologies may be used as long as it allows a user mobile device to transmit wireless signal to a locking device for both data communication and power harvesting.

An energy harvesting component 430 receives the dc power component provided by the duplexer 420 and transforms the form of the power to be suitable for the operation of other components of the electronic locking device 400. Suitable power transforms may include, for example, voltage doubling, filtering out ripple, regulating the voltage level, etc.

A power sensor 435 is functionally connected to the energy harvesting component 430 to sense the amount of the dc power component. In some embodiments, the amount of the dc power component can be sensed by providing the available power to a load (e.g., across a resistor) and then measure the resultant voltage across the load, with the voltage being indicative of the amount of dc power available. A power management component 436 can manage to which component of the device 400 the harvested power from the energy harvesting component 430 is made available, based on the sensed amount of the dc power component from the power sensor 435.

The controller 460 is configured to receive and process the signal from the power sensor 435 and determine whether the sensed amount of dc power is sufficient to operate the electronic locking device 400. In some embodiments, the amount of dc power can be indicated by a measured voltage which can be compared to a predetermined voltage threshold.

A communication component 440 is provided to convert the data between the ac communication component associated with the duplexer 420 and the digital communication data associated with the controller 460. The data converted by the communication component 440 can be further processed by the authentication and crypto component 450 and transmitted by the wireless transceiver 410 to a user mobile device and applied by a network environment for user authentication and data encryption, which will be described further below.

The controller 460 is further configured to process the ac communication component to determine an algorithm to operate the electronic locking device 400, which will be described further below. Various algorithms to operate the electronic locking device 400 can be stored at a memory 462 functionally connected to the controller 460. When the controller 460 determines to lock/close or unlock/open the device 400, the controller 460 can send control signals to the motor drive circuit 472, which then converts the harvested electrical power from the energy harvesting component 430 into a form needed to properly drive motor 472 and drive the motor 474 accordingly. The open/close status of the device 400 can be sensed by a sensor 476 and the sensed status data can be received by the controller 460 and/or stored at the memory 462.

In some embodiments, the electronic locking device 400 can further include an intrinsic safety (IS) circuit to protect the electronic locking device 400 for use in explosive atmospheres or hazardous locations. The IS circuit can be a portion of the power management component 436, or a separate unit. The IS circuit is configured to limit the levels of ignition and heat when the electronic locking device 400 works in potentially explosive atmospheres or hazardous locations. An example of this type of location can be near a fuel storage tank.

Ignition protection can be achieved through limiting of accessible stored energy, namely capacitance and inductance levels. Another consideration is to limit peak voltages and currents available to the electronic locking device 400. Heat protection can be achieved through limiting of overall power to the electronic locking device 400. Typically, the power level of 1.2 W is considered a threshold power for many intrinsic safety certifications and applications. Under 1.2 W heat ignition is often considered not possible. For the electronic locking device described herein, power required for use can be considerably lower than 1.2 W for suitable operation. The IS circuit described herein is provided to limit the maximal available fault power for the use of electronic locking devices described herein by providing protection at the receive end such as an NFC coil.

Figure 6:
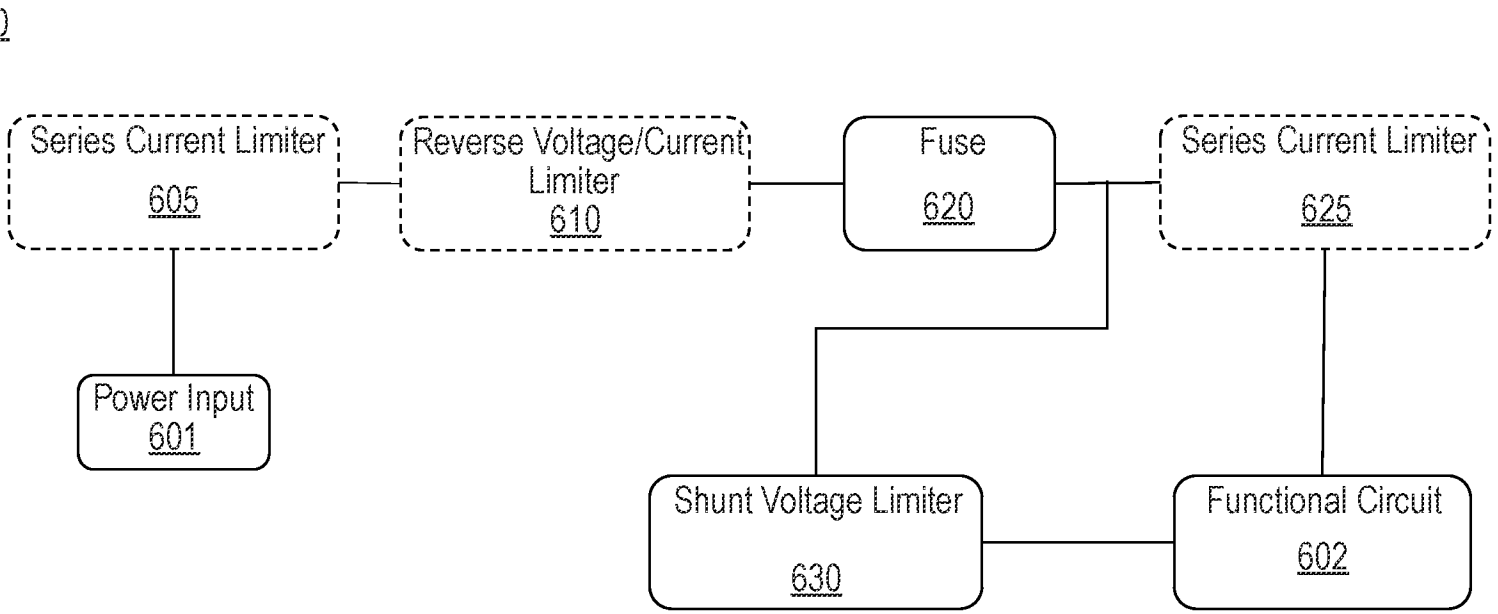
FIG. 6 is a block diagram of an intrinsic safety (IS) circuit, according to one embodiment of this disclosure.

FIG. 6 is a block diagram of an intrinsic safety (IS) circuit 600, according to one embodiment of this disclosure. The IS circuit 600 is configured to at least (i) limit a maximum available power to a functional circuit 602 (e.g., a motorized locking mechanism), (ii) limit a maximum available current to a stored inductance (a motor, a NFC receive coil, etc.), or (iii) limit a maximum available voltage to a stored capacitance (e.g., a microcontroller support cap, a motor start cap, an NFC matching circuit, etc.). Power received from a power input 601 is limited by a thermal limiter 620 and a shunt voltage limiter 630. The thermal limiter 620 can be, for example, a fuse having a limiting current in a range from 0.063 A to 0.300 A, a commonly available fuse range. The shunt voltage limiter 630 can include, for example, a Zener diode having a limiting voltage in a range from 2.5 V to 5.1 V. The combination of typical thermal limiter and shunt voltage limiter may provide safety factors not to exceed, for example, 1.2 W. Optionally, a reverse voltage/current limiter 610 can be provided to prevent reverse current. It may not be required when power received is via an NFC receive coil. The reverse voltage/current limiter 610 can include, for example, a Schottky diode having a typical forward voltage of 0.4 V.

In practical applications, certain additional safety factors or deratings are applied. For example, a 1.7 factor can be applied to all fuses due to the nature of fuse blow times and variability, and an additional 1.5 factor can be applied to the overall calculation as per the International Electrotechnical Commission (IEC) 60079-11:2011 (IEC standard for Intrinsic Safety, Explosive atmospheres—Part 11: Equipment protection by intrinsic safety "i"). For a 63 mA fuse and a 5.1 V Zener diode, the overall power is calculated to be 820 mW (=63 mA×1.7×1.5×5.1V), which is lower than the threshold level of 1.2 W and thus can be considered as a safe power level. When the power required is higher than the threshold power level (e.g., 1.2 W), thermal fuses or thermal cutoffs (TCOs) can be employed to the intrinsic safety (IS) circuit 600 to further limit the heat sources to a maximal temperature along with the use of a heatsink. In some embodiments, optional series current limiter 605 and/or 625 can be included to further limit system current. The optional series current limiter 605 and/or 625 can include, for example, resistors, current limiting circuits, etc. It is to be understood that some types of current limiting ICs may not be considered for IS protection because internal semiconductor elements of the current limiting ICs may not meet spacing requirements in the IEC 60079-11. Other voltage limiting or crowbar circuits can also be implemented to the intrinsic safety (IS) circuit 600 to limit the system voltage. The methods described above can achieve some reductions of available power (thermal ignition) and available stored energy (spark ignition).

Considering the spark ignition consideration factors, the intrinsic safety (IS) circuit 600 can provide limitations to the stored inductance (e.g., at the power input 601 such as a NFC coil, at a functional circuit 602 such as a motor, etc.) and the stored capacitance (e.g., matching circuit typically pF level, motor starting typically nF level, or silicon support capacitors typically uF to 10 s of uF level, etc.).

The intrinsic safety (IS) circuit 600 can provide limitations to the stored capacitance by the shunt voltage limiter 630. For example, for the most stringent protection level with the 1.5 safety factor applied at 5.1 V the maximum capacitance allowed is 88 uF. The 5.1 V limit is set forth by the shunt voltage limiter 630 including, for example, Zener diode(s). The capacitance level can be further increased by adding series resistive elements (e.g., 605, 625, etc.) between the capacitance terminals and the accessible terminals of the device 400.

The intrinsic safety (IS) circuit 600 can provide limitations to the stored inductance by limiting current via series impedances. This can be implemented by considering the resistance of the power input 601 and the functional circuit 602 (e.g., a receive coil, the resistance of the motor, etc.), and by adding additional resistance into the circuit 600 (e.g., 605, 625, etc., assuming all meet the spacings requirements set forth by the IEC 60079-11). It is to be understood that a fuse itself may not be relied for limiting the instantaneous current that could be provided by the power input 601 (e.g., a receive coil). Each element in the device 400 can be characterized to determine a maximal current provided by the device 400 initially, and the current limit can be achieved by adding series current limiting resistors in the circuit 600. For example, with a 5.1 V Zener clamp, the addition of a 5.1 ohm resistor can limit the maximum current to the functional circuit 602 (e.g., a motor) at 1 A (not considering for any additional resistance at the power input 601 and the functional circuit 602, both of which would lower the available current). At a current limit of 1 A, the safe level for inductance becomes 700 uH. Under nominal conditions (e.g., with a current level of about 100 mA), adding the 5.1 ohm resistor can create a 510 mV drop and result in a working voltage of about 4.5 V at the functional circuit 602 (e.g., motor terminals), which is at a level more than adequate for suitable motors (e.g., brushed DC motors) for this application. In many applications, suitable motors may require 1 or 2 V for stable operation.

The electronic locking device 400 may include both capacitive and inductive elements. For example, the power input 601 may include a receive coil. The functional circuit 602 may include a motor, a support capacitor, etc. For this case, it can be shown by calculating the total stored energy of both elements ($0.5\ C \times V^2$ for capacitors and $0.5 \times L \times I^2$ for inductors) that when one element is substantially lower than the limit e.g. 1% thereof, that it can be considered negligible. For example, when less than 1 uF of capacitance is present and the motor inductance is 700 uH. Additionally, it is possible to separate the energy contributions of each type of circuit element by the inclusion of a current limiting resistors separating them. With sufficient resistance the two elements can be considered on their own basis.

In some embodiments, at least a portion of the electronic locking device 400 can be potted or otherwise encapsulated with suitable encapsulation materials able to withstand maximum fault temperatures and with sufficient thickness per IEC 60079-11 to provide intrinsic safety (IS) protection. Exemplary encapsulation material may include hydrogenated terphenyls commercially available from Ellsworth Adhesives (Germantown, Wis.) under the trade designation of EP11121NC. The encapsulation approach reduces the areas of the circuit considered for ignition sources. That is, only the accessible portions of the circuit are evaluated for IS purposes (i.e., accessible capacitance and accessible inductance). In some embodiments, the electronic locking device 400 can be encapsulated except for, e.g., a motor rotor, which needs to be accessible to the atmosphere for operation. In this case, it may be possible to not impose any limits on the stored capacitance. In some embodiments, with proper motor construction (e.g. potted or encapsulated motor windings), it may be possible to not impose limits on stored inductance either. This may not be desired from a manufacturability and cost perspective.

Figure 5:
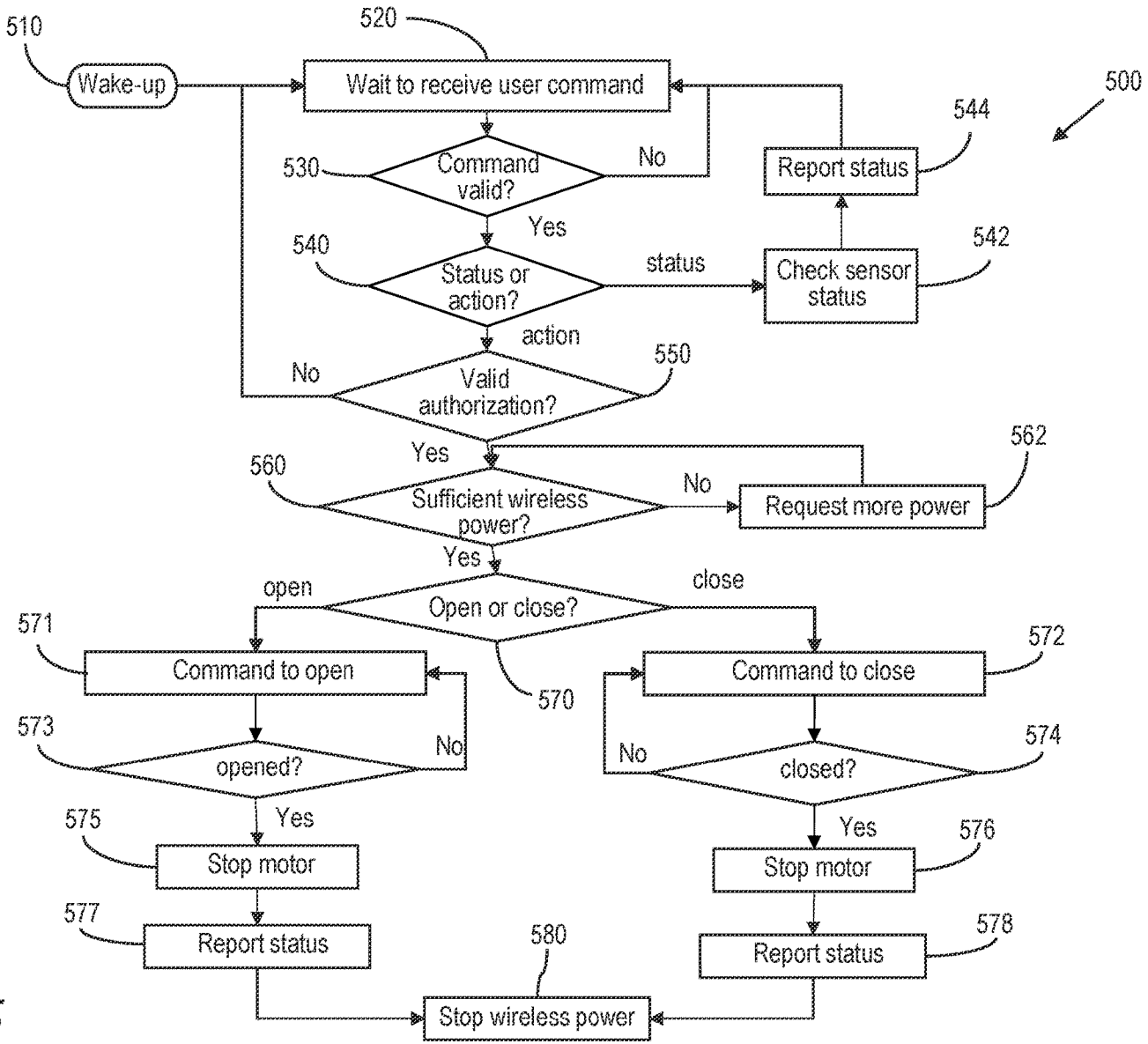
FIG. 5 is a flow diagram of a smart locking/unlocking method, according to one embodiment.

FIG. 5 is a flow diagram of a smart locking/unlocking method 500 using the smart locking systems or devices described herein, according to some embodiments. At 510, a user mobile device can wake up an electronic locking device by approaching the locking device in proximity. The user mobile device can send wireless signals having radio frequency (RF) power impinging on an antenna of wireless transceiver of the electronic locking device. The RF power received by the antenna can flow to an energy harvesting circuit/component which is detected by a power sensor. The power sensor can sense the power level to determine whether there is sufficient power harvested to support the communication between the user mobile device and the electronic locking device.

When there is sufficient harvested power, the method 500 then proceeds to 520 where the user mobile device sends a command signal to the electronic locking device. The command signal may request the locking device to report the status of the lock (e.g., the status of the hasp, or any other data in a memory), to open the lock and report back when the lock is opened, or to close the lock and report back when the lock is closed. The method 500 then proceeds to 530 where the electronic locking device determines whether the received command signal is valid, including, for example, whether the command signal includes a proper header and/or a proper footer, whether the command signal has any bit errors, whether the command signal includes a valid authorization signature, whether the command signal has been property encrypted, etc.

When the electronic locking device determines that the received command signal is invalid, the electronic locking device can communicate the determination to the user mobile device which can indicate to the user the reasons that the command signal is invalid (e.g., due to mismatched signatures). The method 500 then proceeds back to 520.

When the electronic locking device determines that the received command signal is valid, the method 500 proceeds to 540 where the electronic locking device determines the content of the command signal including, for example, whether the received command signal requires a status report of the mechanical state of the locking device, or to perform a mechanical action to change the physical state of the locking device.

When the electronic locking device determines that the command signal required a status report of the mechanical state of the locking device, the method 500 proceeds to 542 where the electronic locking device checks the status of the locking device by, e.g., checking the open/closed status as sensed by a hasp sensor. The method 500 then proceeds to 544 where the electronic locking device transmits a report of mechanical state of the locking device to the user mobile device. The method 500 then proceeds back to 520.

When the electronic locking device determines that the received command signal requires to perform a mechanical action to change the physical state of the locking device, the method 500 proceeds to 550 where the electronic locking device further determines whether the command signal asking to open or close the locking device includes a valid authorization signature to perform this function.

When the electronic locking device determines that the command signal asking to open or close the locking device includes no valid authorization signature, the electronic locking device can communicate the determination to the user mobile device which can indicate to the user the reasons that the communication between the user mobile devices 110 and the electronic locking devices 130 is invalid (e.g., no valid authorization signature). The method 500 proceeds back to 520.

When the electronic locking device determines that the command signal asking to open or close the locking device includes a valid authorization signature, the method 500 then proceeds to 560 where the electronic locking device determines whether its power sensor indicates that there is sufficient power harvested to support a mechanical action (e.g., locking or unlocking the hasp).

When the electronic locking device determines that the harvested power is not sufficient to support a mechanical action, the method 500 then proceeds to 562 where the electronic locking device transmits a request to the user mobile device for more power.

The user mobile device can present a request to the user to change the location or orientation of the mobile device, for example, to place the mobile device closer to the locking device. The method 500 then proceeds back to 560.

When the electronic locking device determines that the harvested power is sufficient to support a mechanical action, the method 500 then proceeds to 570 where the electronic locking device further determines whether the command signal asks to open or close the locking device.

When the electronic locking device determines that the command signal asks to open the locking device, the method 500 proceeds to 571 where the electronic locking device commands its motor drive circuit to open the locking device. The method 500 then proceeds to 573 where the electronic locking device checks its sensor to detect whether the hasp is in a fully opened position. When the electronic locking device detects that the hasp is in a fully opened position, the method 500 proceeds to 575 where the electronic locking device commands the motor driver circuit to stop driving the motor. The method 500 proceeds to 577 where the electronic locking device transmits a report to the user mobile device that the locking device is in an opened status. The method 500 then proceeds to 580 where the user mobile device stops transmitting wireless power to the electronic locking device upon receiving the report from the locking device.

When the electronic locking device determines that the command signal asks to lock the locking device, the method 500 proceeds to 572 where the electronic locking device commands its motor drive circuit to lock the locking device. The method 500 then proceeds to 574 where the electronic locking device checks its sensor to detect whether the hasp is in a fully closed position. When the electronic locking device detects that the hasp is in a fully closed position, the method 500 proceeds to 576 where the electronic locking device commands the motor driver circuit to stop driving the motor. The method 500 then proceeds to 578 where the electronic locking device transmits a report to the user mobile device that the locking device is in a closed status. The method 500 then proceeds to 580 where the user mobile device stops transmitting wireless power to the electronic locking device upon receiving the report from the locking device.

Exemplary embodiments of the present disclosure may take on various modifications and alterations without departing from the spirit and scope of the present disclosure. Accordingly, it is to be understood that the embodiments of the present disclosure are not to be limited to the following described exemplary embodiments, but is to be controlled by the limitations set forth in the claims and any equivalents thereof.

Listing of Exemplary Embodiments

Exemplary embodiments are listed below. It is to be understood that any one of the embodiments 1-14, 15-24 and 25-29 can be combined.

Embodiment 1 is an electronic locking device comprising:

a wireless transceiver including an antenna configured to receive wireless signals;

a duplexer functionally connected to the antenna to separate the received wireless signal into a power component and a communication component;

a power sensor to sense the amount of the power component; and a controller configured to:

determine whether the sensed amount of the power component is enough to operate the electronic locking device; and process the communication component to determine an algorithm to operate the electronic locking device.

Embodiment 2 is the electronic locking device of embodiment 1, further comprising an energy harvesting component configured to convert the power component to electrical power.

Embodiment 3 is the electronic locking device of embodiment 1 or 2, further comprising a communication component to provide a conversion between the communication component associated with the duplexer and digital communication data associated with the controller.

Embodiment 4 is the electronic locking device of any one of embodiments 1-3, further comprising a power management component configured to supply at least a portion of the power component of the wireless signal to power an electronically controllable locking mechanism.

Embodiment 5 is the electronic locking device of any one of embodiments 1-4, wherein the power management component is further configured to supply at least a portion of the power component of the wireless signal to power the processor.

Embodiment 6 is the electronic locking device of any one of embodiments 1-5, wherein the electronically controllable locking mechanism includes a motorized locking mechanism.

Embodiment 7 is the electronic locking device of any one of embodiments 1-6, further comprising a padlock body.

Embodiment 8 is the electronic locking device of any one of embodiments 1-7, further comprising a padlock hasp operable in an opened or closed position.

Embodiment 9 is the electronic locking device of any one of embodiments 1-8, further comprising a memory to store secured data.

Embodiment 10 is the electronic locking device of any one of embodiments 1-9, further comprising one or more sensors to detect a locked/unlocked status of the device.

Embodiment 11 is the electronic locking device of any one of embodiments 1-10, further comprising an intrinsic safety (IS) circuit to provide ignition and heat protection for the electronic locking device for use in explosive atmospheres or hazardous locations.

Embodiment 12 is the electronic locking device of embodiment 11, wherein the IS circuit comprises a fuse, and a shunt voltage limiter, and optionally, one or more series current limiter, and one or more of a reverse voltage/current limiter.

Embodiment 13 is the electronic locking device of embodiment 11 or 12, wherein the IS circuit is configured to at least (i) limit a maximum available power to a motorized locking mechanism of the device, (ii) limit a maximum available current to a stored inductance of the device, or (iii) limit a maximum available voltage to a stored capacitance of the device.

Embodiment 14 is the electronic locking device of any one of embodiments 1-13, further comprising an encapsulation lay to encapsulate at least a portion of the device to provide ignition and heat protection for the electronic locking device for use in explosive atmospheres or hazardous locations.

Embodiment 15 is a smart locking system comprising:

one or more of the electronic locking devices of any one of embodiments 1-14; and one or more user mobile devices, each user mobile device providing a user interface allowing a user access to the one or more electronic locking devices.

Embodiment 16 is the smart locking system of embodiment 15, further comprising a server providing a network interface allowing the server to establish a wireless connection with the one or more user mobile devices.

Embodiment 17 is the smart locking system of embodiment 15 or 16, wherein the server includes a device interface module to provide a user interface to the one or more user mobile devices.

Embodiment 18 is the smart locking system of any one of embodiments 15-17, wherein the server further includes a security module to generate and store user authentication and encryption data.

Embodiment 19 is the smart locking system of any one of embodiments 15-18, wherein the one or more user mobile devices each includes a wireless transceiver to transmit the wireless signal to the antenna of the wireless transceiver of the electronic locking devices.

Embodiment 20 is the smart locking system of any one of embodiments 15-19, wherein the wireless transceiver of the user mobile devices transmits user command signal to the wireless transceiver of the electronic locking devices.

Embodiment 21 is the smart locking system of any one of embodiments 15-20, wherein the wireless transceiver of the user mobile devices receives locking device status data from the wireless transceiver of the electronic locking devices.

Embodiment 22 is the smart locking system of any one of embodiments 15-21, wherein the locking device status data includes a power level status related to whether the sensed amount of the power component is sufficient to operate the electronic locking device.

Embodiment 23 is the smart locking system of any one of embodiments 15-22, wherein the user interface of the user mobile device presents a notification to the user to adjust the position or orientation of the user mobile device relative to the locking device based on the received power level status.

Embodiment 24 is the smart locking system of any one of embodiments 15-23, wherein the one or more user mobile devices and the one or more electronic locking devices communicate via an NFC connection.

Embodiment 25 is a smart locking method comprising:

impinging a wireless signal from a user mobile device on an antenna of an electronic locking device;

sensing the power level of the wireless signal;

determining whether the sensed power level is sufficient to operate the electronic locking device; and processing the wireless signal to determine an algorithm to operate the electronic locking device.

Embodiment 26 is the smart locking method of embodiment 25, further comprising determining, based on the sensed power level of the wireless signal, whether the power level is sufficient to support the communication between the user mobile device and the electronic locking device.

Embodiment 27 is the smart locking method of embodiment 25 or 26, further comprising determining, based on the sensed power level of the wireless signal, whether the power level is sufficient to open or close the electronic locking device.

Embodiment 28 is the smart locking method of any one of embodiments 25-27, further comprising generating and storing user authentication and encryption data in a network environment.

Embodiment 29 is the smart locking method of any one of embodiments 25-28, further comprising communicating the authentication and encryption data between the network environment and the user mobile device.

Reference throughout this specification to "one embodiment," "certain embodiments," "one or more embodiments," or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment," or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments. While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. Furthermore, various exemplary embodiments have been described. These and other embodiments are within the scope of the following claims.

What is claimed is:

1. An electronic locking device comprising:

a wireless transceiver including an antenna configured to receive wireless signals;

a duplexer functionally connected to the antenna to separate the received wireless signal into a power component and a communication component;

a power sensor to sense the amount of the power component from the wireless signal; and a controller configured to:

determine whether the sensed amount of the power component from the wireless signal is enough to operate the electronic locking device, when the controller determines that the sensed amount of the power component from the wireless signal is not enough, the controller generates a request; and process the communication component to determine an algorithm to operate the electronic locking device.

2. The electronic locking device of claim 1, further comprising an energy harvesting component configured to convert the power component to electrical power.

3. The electronic locking device of claim 1, further comprising a communication component to provide a conversion between the communication component associated with the duplexer and digital communication data associated with the controller.

4. The electronic locking device of claim 1, further comprising a padlock body.

5. The electronic locking device of claim 1, further comprising a padlock hasp operable in an opened or closed position.

6. The electronic locking device of claim 1, further comprising a memory to store secured data.

7. The electronic locking device of claim 1, further comprising one or more sensors to detect a locked/unlocked status of the device.

8. The electronic locking device of claim 1, further comprising an encapsulation lay to encapsulate at least a portion of the device to provide ignition and heat protection for the electronic locking device for use in explosive atmospheres or hazardous locations.

9. A smart locking system comprising:

one or more of the electronic locking devices of claim 1; and one or more user mobile devices, each user mobile device providing a user interface allowing a user access to the one or more electronic locking devices, wherein when the controller determines that the sensed amount of the power component from the wireless signal is not enough, the user mobile device receives the request from the electronic locking devices and presents, via the user interface, a request to the user to change a location or orientation of the user mobile device with respect to the electronic locking devices.

10. The electronic locking device of claim 1, further comprising a power management component configured to supply at least a portion of the power component of the wireless signal to power an electronically controllable locking mechanism.

11. The electronic locking device of claim 10, wherein the power management component is further configured to supply at least a portion of the power component of the wireless signal to power the processor.

12. The electronic locking device of claim 10, wherein the electronically controllable locking mechanism includes a motorized locking mechanism.

13. The electronic locking device of claim 1, further comprising an intrinsic safety (IS) circuit to provide ignition and heat protection for the electronic locking device for use in explosive atmospheres or hazardous locations.

14. The electronic locking device of claim 13, wherein the IS circuit comprises a fuse, and a shunt voltage limiter, and optionally, one or more series current limiter, and one or more of a reverse voltage/current limiter.

15. The electronic locking device of claim 13, wherein the IS circuit is configured to at least (i) limit a maximum available power to a motorized locking mechanism of the device, (ii) limit a maximum available current to a stored inductance of the device, or (iii) limit a maximum available voltage to a stored capacitance of the device.

16. A smart locking method comprising:

impinging a wireless signal from a user mobile device on an antenna of an electronic locking device;

sensing the power level of the wireless signal;

determining whether the sensed power level is sufficient to operate the electronic locking device, when the sensed power level of the wireless signal is not sufficient, transmitting a request from the electronic locking device to the user mobile device, and presenting, via the user mobile device, a request to change a location or orientation of the user mobile device with respect to the electronic locking device; and processing the wireless signal to determine an algorithm to operate the electronic locking device.

17. The smart locking method of claim 16, further comprising determining, based on the sensed power level of the wireless signal, whether the power level is sufficient to support the communication between the user mobile device and the electronic locking device.

18. The smart locking method of claim 16, further comprising determining, based on the sensed power level of the wireless signal, whether the power level is sufficient to open or close the electronic locking device.

19. The smart locking method of claim 16, further comprising generating and storing user authentication and encryption data in a network environment.

20. The smart locking method of claim 19, further comprising communicating the authentication and encryption data between the network environment and the user mobile device.

* * * * *